United States Patent [19]

Kogane et al.

[11] Patent Number: 4,892,019

[45] Date of Patent: Jan. 9, 1990

[54] SHEET PUNCHING CUTTER

[75] Inventors: Mikio Kogane; Mizuho Nishimura, both of Kanagawa; Tsutomu Kimura, Tokyo, all of Japan

[73] Assignee: Fuji Photo Film Co., Ltd., Kanagawa, Japan

[21] Appl. No.: 85,600

[22] Filed: Aug. 14, 1987

[30] Foreign Application Priority Data

| | | | |
|---|---|---|---|
| Aug. 28, 1986 | [JP] | Japan | 61-202551 |
| Aug. 28, 1986 | [JP] | Japan | 61-202552 |
| Aug. 29, 1986 | [JP] | Japan | 61-203476 |
| Aug. 29, 1986 | [JP] | Japan | 61-203477 |

[51] Int. Cl.[4] ..... B26D 7/18; B26D 9/00

[52] U.S. Cl. ..... 83/105; 83/110; 83/123; 83/140; 83/150; 83/156; 83/682

[58] Field of Search ..... 83/102, 105, 110, 123, 83/124, 125, 126, 128, 134, 139, 143, 145, 146, 214, 618, 682

[56] References Cited

U.S. PATENT DOCUMENTS

| | | | |
|---|---|---|---|
| 1,618,048 | 2/1927 | Bates et al. | 83/656 X |
| 2,655,842 | 10/1953 | Baumgartner | 83/105 X |
| 3,517,580 | 6/1970 | Sturm | 83/682 |
| 4,022,087 | 5/1977 | Queen et al. | 83/156 X |

*Primary Examiner*—Hien H. Phan

*Attorney, Agent, or Firm*—Sughrue, Mion, Zinn, Macpeak & Seas

[57] ABSTRACT

A cutter for punching a sheet of material having a fixed block disposed so as to face one side of the sheet, a moving blade disposed at the opposite side of the sheet relative to the fixed block, and a transporting roller disposed inside the moving blade. A punched-out portion is thereby transported along with a punched-remainder portion.

19 Claims, 8 Drawing Sheets

SHEET PUNCHING CUTTER

BACKGROUND OF THE INVENTION

This invention relates to a sheet punching cutter for punching a sheet of photosensitive material or the like into a piece of a desired shape.

In the process of making a negative print of photographic images, a part of a roll of unused photographic paper is drawn out, images on a negative film or a CRT is printed on the photographic paper, and a sheet of negative print obtained by development is cut and separated at the side of every picture by using a cutting blade having a linear blade portion.

In some cases, portions of picture areas in the negative print are punched into pieces of a desired size as products. This process is mainly applied to the production of driver's licenses or ID cards.

In that case, it is necessary for the operation of punching desired picture portions out of a lengthwise negative print sheet to use a type of cutter which has a male die corresponding to the punching shape and a female die for receiving this male die. This type of cutter is large and expensive and needs to be adjusted in accordance with the dimensions of the male and female dies at the time of assembly.

SUMMARY OF THE INVENTION

The present invention has been achieved in consideration of the above-described facts and an object of the present invention is to provide a sheet punching cutter which eliminates the need for the manufacture of a female die and adjustment of dimensions when used to produce, by punching, a pieces of a desired size from a sheet of material.

To this end, the present invention provides in one of its aspects a sheet punching cutter having: a fixed block disposed so as to face one surface of a sheet of material; a moving punching blade brought close to and moved away from the fixed block so as to punch a desired portion of the sheet; and a transporting roller disposed inside the moving punching blade and adapted for transporting a punched-out portion of the sheet punched by the moving punching blade.

In the construction in accordance with the present invention, the moving blade is moved close to or away from the fixed block. This differs from the conventional arrangement in which a desired portion of the sheet is punched by engaging male and female dies with each other. The construction in accordance with the present invention is simple since the present invention has been designed to simply move the moving blade close to or away from the fixed block, thereby eliminating the need for adjustment of the dimensions of the male and female dies. Moreover, it is possible to transport a punched-out portion along with a punched-remainder portion by disposing the transporting roller inside the moving blade.

The present invention provides in another of its aspects a sheet punching cutter further having a separating means for guiding the punched-out portion and the punched-remainder portion of the sheet in different directions.

The present invention provides in still another of its aspects a sheet punching cutter further having a transporting means for moving the sheet to the punching position at which the sheet is punched, and moving the sheet away from the punching position, wherein the speed at which the sheet is transported by the transporting roller and the speed at which the sheet is transported by the transporting means are different from each other.

DESCRIPTION OF PREFERRED EMBODIMENTS

Figure 1:
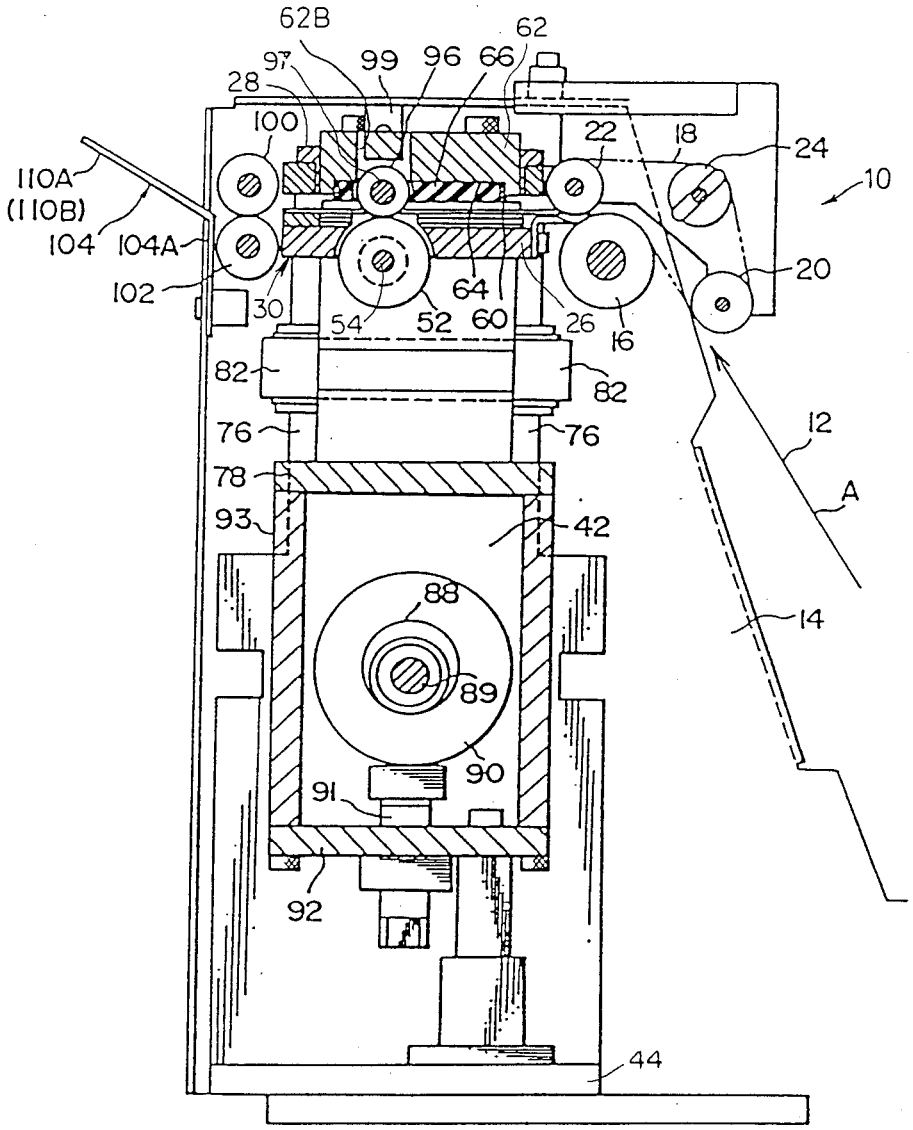
FIG. 1 is a longitudinal sectional view of a sheet punching cutter which represents a first embodiment of the present invention.
Figure 2:
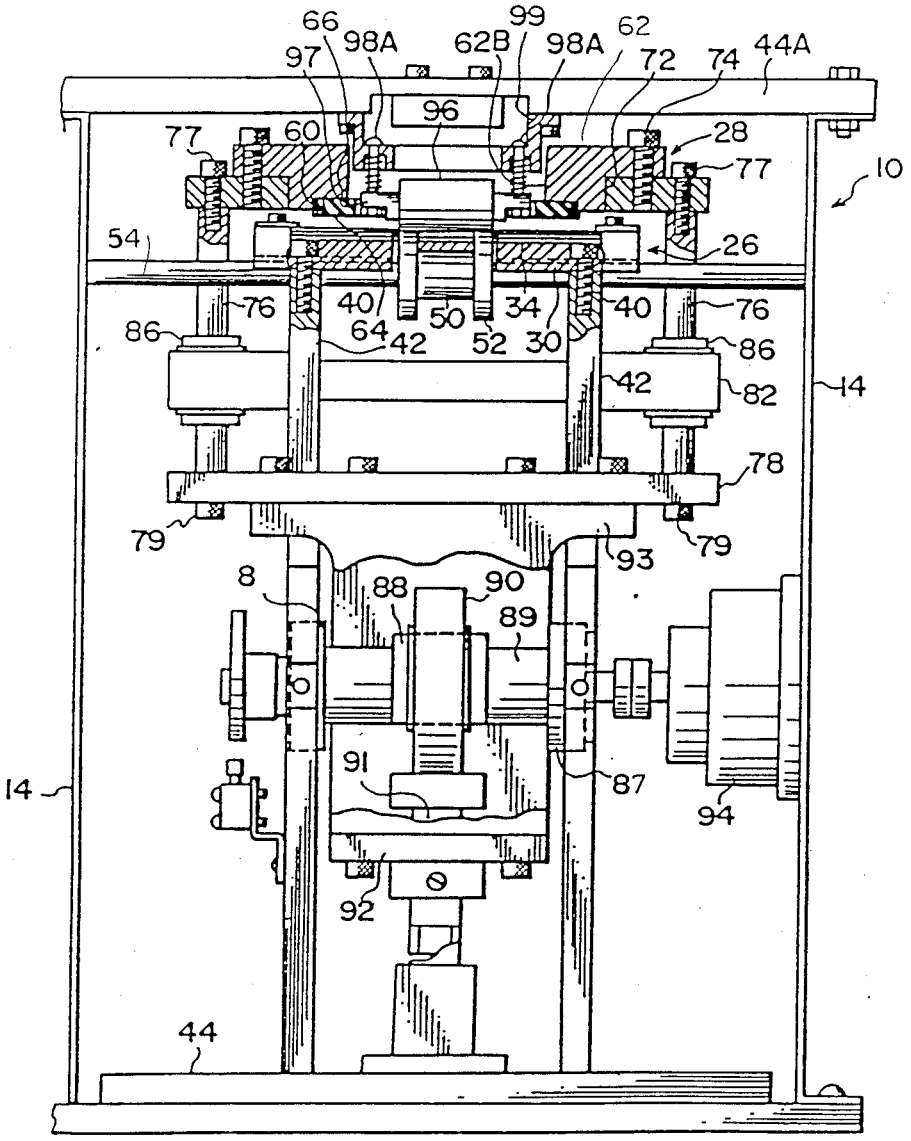
FIG. 2 is a cross-sectional view of the sheet punching cutter shown in FIG. 1.

FIGS. 1 and 2 illustrate a punching cutter 1 which represents a first embodiment of the present invention. The punching cutter 10 allows a sheet of photographic paper 12 which has undergone printing and development of an image in the preceding step (not shown) to be transported between a pair of side plates 14 in the direction indicated by the arrow A.

A winding roller 16 is disposed between the pair of side plates 14 so that the photographic paper 12 is transported in the horizontal direction after being tightly pressed against the winding roller 16 by a pressing belt 18 which is endless and is wound around winding rollers 20, 22 and 24. The winding roller 20 rotates by receiving a driving force of a motor (not shown).

The photographic paper 12 which is being fed out between the winding roller 16 and the pressing belt 18 enters the gap between a fixed block 26 and a moving block 28.

Figure 3:
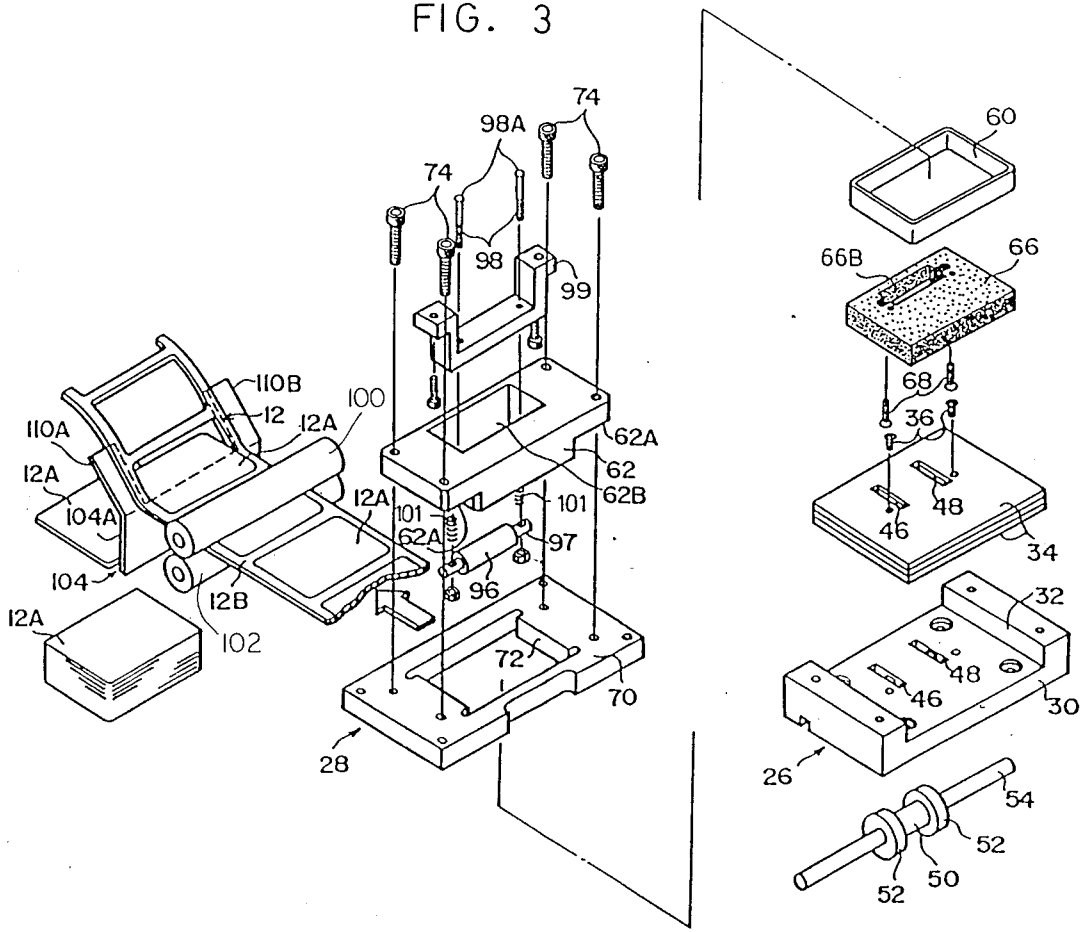
FIG. 3 is an exploded perspective view of a fixed block, a moving block and other related parts of the first embodiment.

As shown in FIG. 3, the fixed block 26 is provided with a base plate 30 which has a cut recess 32 in which a plurality of brass seat plates 34 are accommodated, and the block 26 is adapted to allow the photographic paper 12 to pass over the seat plates 34.

The seat plates 34 are fixed to the base plate 30 by small screws 36 so that the photographic paper 12 is placed on the upper most seat plate 34.

The widthwise opposite ends of the base plate 30 are fixed, as shown in FIG. 2, to the upper ends of vertical brackets 42 by attachment bolts 40, and the vertical brackets 42 are fixed to a machine base 44.

Rectangular holes 46 and 48 are formed through the base plate 30 and the seat plates 34 on opposite sides of the center line in the direction of transportation of the photographic paper 12, so that large-diameter portions 52 of a lower roller 50 projects through these rectangular holes. That is, the large-diameter portions 52 of the lower roller 50 pass through the rectangular holes 46 and 48 of the seat plates 34 and contact the lower surface of the photographic paper 12 when the paper is transported. A support shaft 54 which is inserted into and fixed to the lower roller 50 such as to be coaxial with this roller passes through the brackets 42 and the opposite ends of the shaft 54 are axially supported by the side plates 14.

The shaft 54 is rotated by a driving force of a driving means (not shown).

An annular or endless moving punching blade 60 is mounted on a cutting plate 62 disposed on the moving block 28. The moving blade 60 is formed by bending a thin plate member in such a manner that the longitudinal axis of the thin plate member forms a rectangle. The upper end of the moving blade 60 is accommodated in a recess 64 which is formed in a lower surface of the cutting plate 62, and the lower end projects downwardly from the cutting plate 62. A resilient block 66 is disposed in the moving blades 60 and fixed to the cutting plate 62 by small screws 68. This resilient block 66 is formed from a resilient material such as polyvinyl chloride or a spongelike material and acts to force a punched-out portion 12A of the photographic paper 12 from the moving blade 60.

The cut plate 62 has a rectangular hole 62B which is formed generally at the center of the cutting plate 62 and which accommodates an upper roller 96. A support shaft 97 which passes through the upper roller 96 and is coaxial with this roller is fixed by screw means to the lower ends of guide shafts 98 which pass though a fixed plate 99 which is fixed to the machine base 44 by a top plate 44A and the side plates 14. The upper ends of the guide shafts 98 project toward the upper end of the fixed plate 99, and the downward movements of the guide shafts 98 are limited by their large-diameter portions 98A. Compression coil springs 101 are fitted around the guide shafts 98 and are interposed between the support shaft 97 and the fixed plate 99, so that the upper roller 96 is pressed against the lower roller 50 by the urging force of the compression coil springs 101, thereby providing a force of transporting the punched-out portion 12A after punching. As is understood from FIGS. 1 and 2, the size of the rectangular hole 62B is determined so that it can accommodates the fixed plate 99.

Even when punching is inadequate, the separation of the punched-out portion 12A from the photographic paper 12 can be facilitated by slightly increasing or reducing the transportation speed of the upper roller 96 and the lower roller 50 relative to that of the other members, namely, the winding roller 16, an upper transporting roller 100, a lower transporting roller 102, and so forth.

A rectangular hole 66B through which the upper roller 96 passes is formed in the resilient block 66 which is disposed in the moving blade 60.

The cutting plate 62 is inserted into a rectangular hole 72 which is formed at the center of a pressing plate 70, and thin flanges 62A which project from the widthwise opposite ends of the cutting plate are fixed to the pressing plate 70 by attachment bolts 74.

As shown in FIG. 2, the upper ends of guide rods 76 are connected to the pressing plate 70 by bolts 77 at the opposite sides of the rectangular hole 72, the lower ends of the guide rods 76 are fixed to the upper end of a coupling plate 78 by bolts 79.

An intermediate portion of each guide rod 76 is axially supported by a bearing 86 on a supporting plate 82, and the supporting plate 82 is fixed to the vertical brackets 42. The cutting plate 62 is linearly moved in the vertical direction by the coupling plate 78 through the medium of the pressing plate 70 while being guided by the supporting plate 82.

A shaft 89 of an eccentric cam 88 is axially supported by bearings 87 between the vertical brackets 42. The outer surface of the eccentric cam 88 is fitted to a bearing 90 while aligning the axes thereof. The head of a bolt 91 faces the lower end of the bearing 90. The bolt 91 is screwed into a lifting plate 92, and opposite ends of the lifting plate 92 are connected to the coupling plate 78 by lifting side walls 93. The shaft 89 is connected to the output shaft of a motor 94. When the motor 94 rotates the eccentric cam 88, the eccentric cam moves the lifting plate 92 and the lifting walls 93 in the vertical direction, and the guide rod lifts the moving block 28 up and down so that the moving block 28 is brought close to and moved away from the fixed block 26.

When the moving block 28 is moved to the lowermost position, the lower end of the moving blade 60 contacts the seat plate 34 on the fixed block 26, and a rectangular punched-out portion 12A of the photographic paper 12A passing through the gap between the moving block 28 and the fixed block 26 is thereby formed and cut out to be separated from a punched-remaining portion 12B.

After punching, the photographic paper 12 which has passed through the gap between the fixed block 26 and the moving block 28 passes through the gap between the upper transporting roller 100 and the lower transporting roller 102. The diving force of a motor (not shown) acts on one of the upper and lower transporting rollers 100 and 102, thereby transporting the photographic paper 12.

A separation guide 104 which constitutes a separating means such as that shown in FIG. 3 in detail is disposed so as to face an outlet portion at the upper and lower transporting rollers 100 and 102. One side 104A of the guide 104 is fixed to the machine base 44, and arms 110A and 110B extending from this side projects upward such as to correspond to the opposite sides of the punched-remainder portion 12B.

In the separation guide thus formed, the punched-out portion 12A is allowed to pass through the area between the arms 110A and 110B, as shown in FIG. 3, and is thereafter stored.

The operation of the first embodiment will now be described below.

An image is printed in the preceding process (not shown), and a developed photographic paper 12 is supplied to the gap between the fixed block 26 and the moving block 28 after passing through the gap between the winding roller 16 and the pressing belt 18.

Then, when the motor 94 rotates, the guide rods 76 operate to downwardly move the moving block 28 by the rotation of the eccentric cam 88, thereby pressing the moving blade 60 against the seat plate 34. The photographic paper 12 is thereby separated into a punched-out portion 12A and a punched-remainder portion 12B.

After punching, the moving block 28 is lifted, and a tensile force caused by the upper and lower transporting rollers 100 and 102 acts on the punched-remainder portion 12B so that this portion is transported toward the separation guide 104. On the other hand, the punched-out portion 12A is supplied with a driving force from the lower roller 50 and the upper roller 96 and is transported together with the punched-remainder portion 12B through it has been separated therefrom.

When the photographic paper reaches the separation guide 104, the punched-remainder portion 12B is guided by the separation guide 104 and is moved upward. On the other hand, the punched-out portion 12A moves straight in the same direction and is stacked. Thus, the punched-out portion 12A and the punched-remainder portion 12B are separated suitably, the punched-out portion 12A is utilized as a product, and the punched-remainder portion 12B is wound around a roller or the like (not shown) and is thereafter discharged as waste.

Even if the punched-out portion 12A has not been adequately punched out of the punched-remainder portion 12B and if the punched-out portion 12A is partly connected to the punched-remainder portion 12B, it is possible to completely separate the punched-out portion 12A from the punched-remainder portion 12B.

Figure 4:
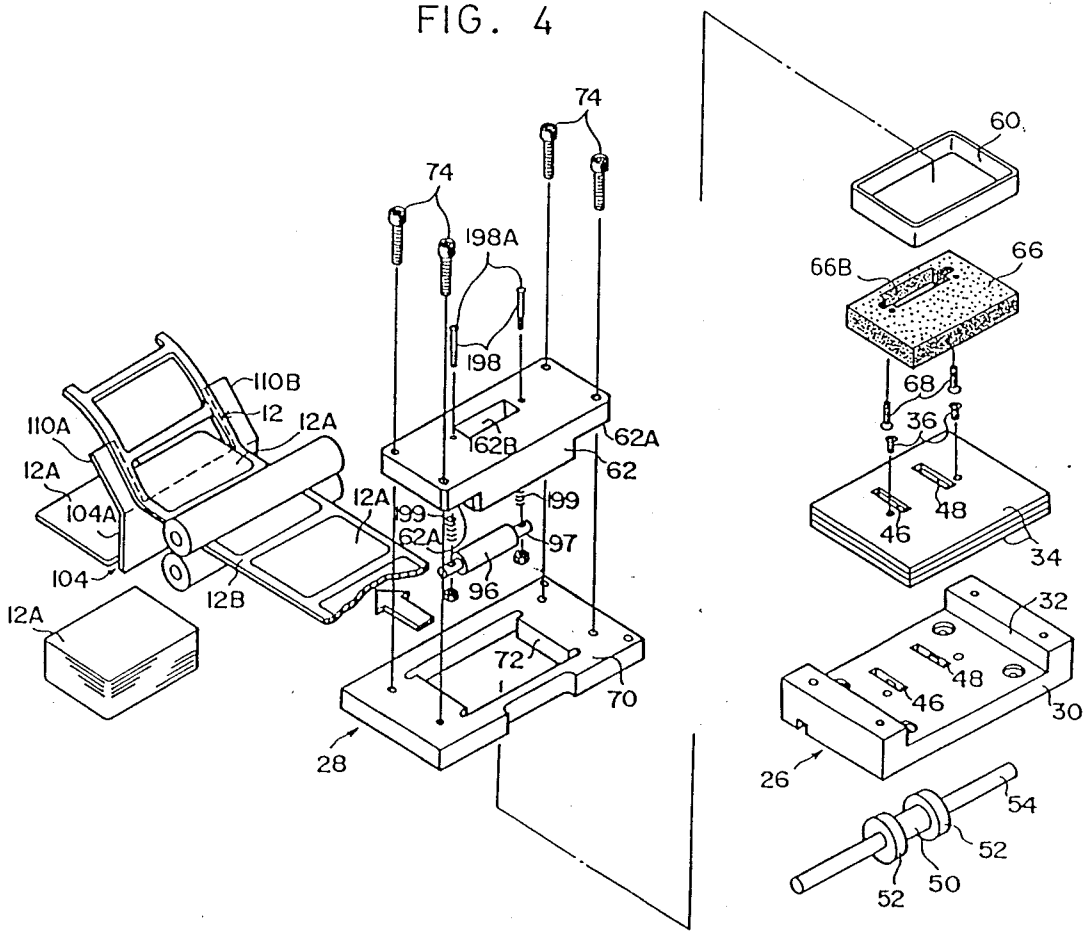
FIG. 4 is an exploded perspective view of a second embodiment of the present invention corresponding to FIG. 3 of the first embodiment.

A second embodiment of the present invention will be described below with reference to FIG. 4.

In this embodiment, the same components and members as those in the first embodiment are indicated by the same reference numerals, and the description for them will not be repeated.

This embodiment differs from the first embodiment in that the upper roller 96 is not supported on the moving block 28, the fixed plate is not provided, and the upper roller 96 is supported by the cutting plate 62. The support shaft 97 of the upper roller 96 is fitted through threaded portions to the lower ends of guide shafts 198 which pass through the cutting plate 62. The large-diameter portions 198A which are formed at the upper ends of the guide shafts 198 and which project toward the upper surface of the cutting plate 62 function to limit the extent of downward movements of the guide shafts 198. Compression coil springs 199 are fitted around the shafts 198 and are interposed between the support shaft 97 and the cutting plate 62. The upper roller 96 is pressed against the lower roller by the urging force of the compression coil springs 199, thereby causing a force of transporting a punched-out portion 12A after punching. In this embodiment, as is understood from the drawings, the size of a rectangular hole 162B which is formed generally at the center of the cutting plate 62 is smaller than the rectangular hole 62B in the first embodiment. This is because it is sufficient for the rectangular hole 162B in this embodiment to have a size large enough to accommodate the upper roller 97.

Other constructions and functions in accordance with the second embodiment are the same as those in the first embodiment and, therefore, the description for them will not repeated.

Figure 5:
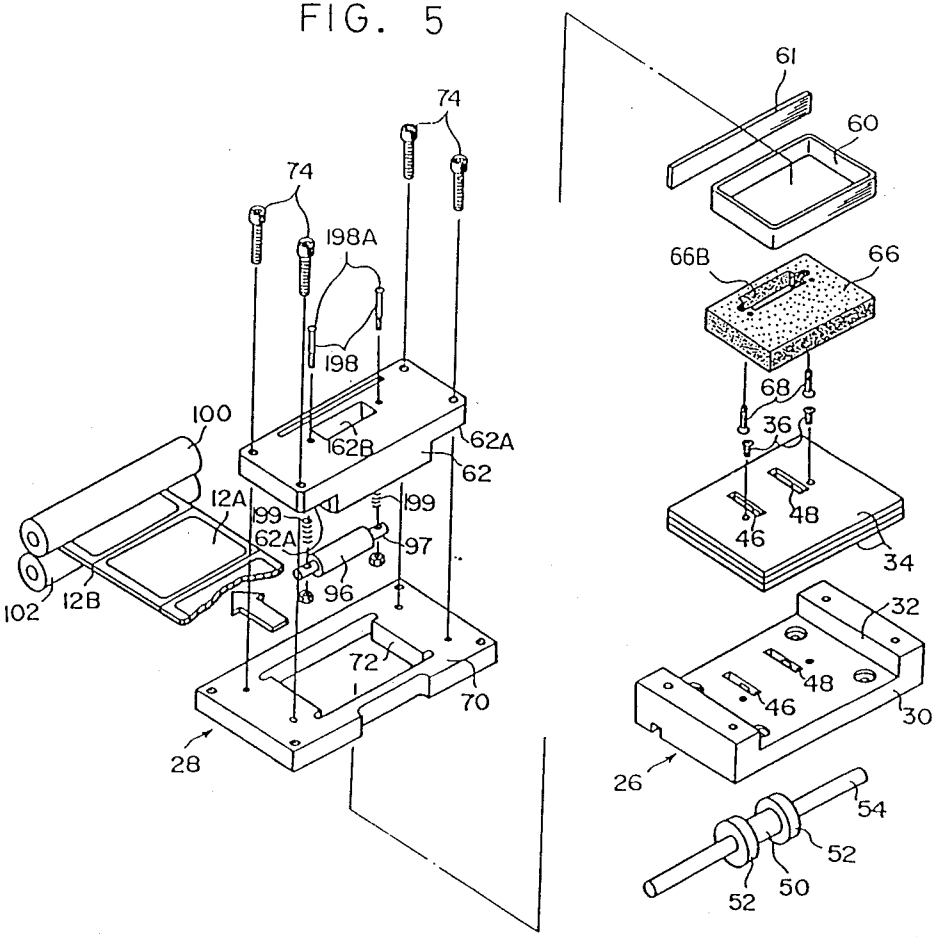
FIG. 5 is an exploded perspective view of a third embodiment of the present invention corresponding to FIG. 3 of the first embodiment.
Figure 6:
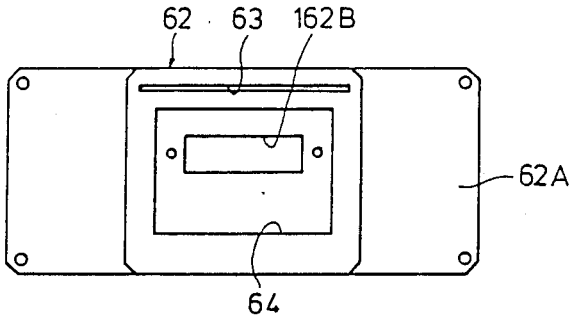
FIG. 6 is a bottom view of a cutting plate used in the third embodiment.

A third embodiment of the present invention will be described below with reference to FIGS. 5 and 6. In this embodiment, the same components and members as those in the second embodiment are indicated by the same reference numerals, and the description for them will not be repeated.

This embodiment differs from the first embodiment in that a moving cutting blade 61 is provided along with the moving punching blade 60. The moving cutting blade 61 is in the form of a straight plate, and its one side in the widthwise direction is accommodated in a slit 63 which is formed in a lower surface of the cutting plate 62, and the other side projects toward the seat plate 34. The extent of projection of the moving cutting blade 61 is substantially the same as that of the moving punching blade 60. The moving cutting blade is adapted to cut a punched-remainder portion 12B perpendicularly to the longitudinal direction thereof.

Other constructions are the same as those in the second embodiment and the description for them will not be repeated.

The operation of this embodiment will now be described below.

An image is printed in the preceding process (not shown), and a developed photographic paper 12 is supplied to the gap between the fixed block 26 and the moving block 28 after passing through the gap between the winding roller 16 and the pressing belt 18.

Then, when the motor 94 rotates, the guide rods 76 operate to downwardly move the moving block 28 by the rotation of the eccentric cam 88, thereby pressing the moving punching blade 60 and the moving cutting blade 61 against the seat plate 34. The photographic paper 12 is thereby separated into a punched-out portion 12A and a punched-remainder portion 12B, and at the same time, the punched-remainder portion is cut at a position between adjacent pictures.

After punching, the moving block 28 is lifted, a driving force caused by the upper and lower transporting rollers 100 and 102 and the lower and upper rollers 50 and 96 acts on the the punched-out portion 12A and the punched-remainder portion 12B so that these portions 12A and 12B are transported to the next process though they have been separated from each other.

Specifically, it is possible to discharge the punched-remainder portion 12B as waste by being simply accommodated in a box or the like without being wound and removed by using a particular means, since the punched-remainder portion 12B has been cut at the side of every picture.

Figure 8:
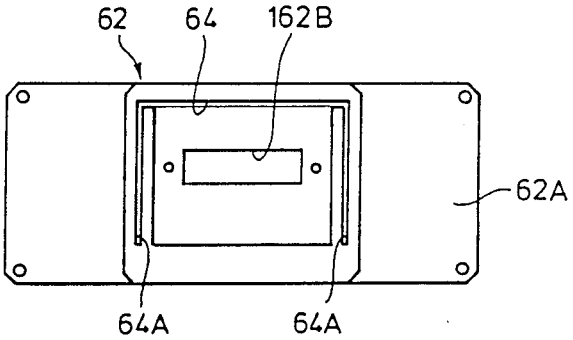
FIG. 8 is a bottom view of a cutting plate used in the fourth embodiment.
Figure 7:
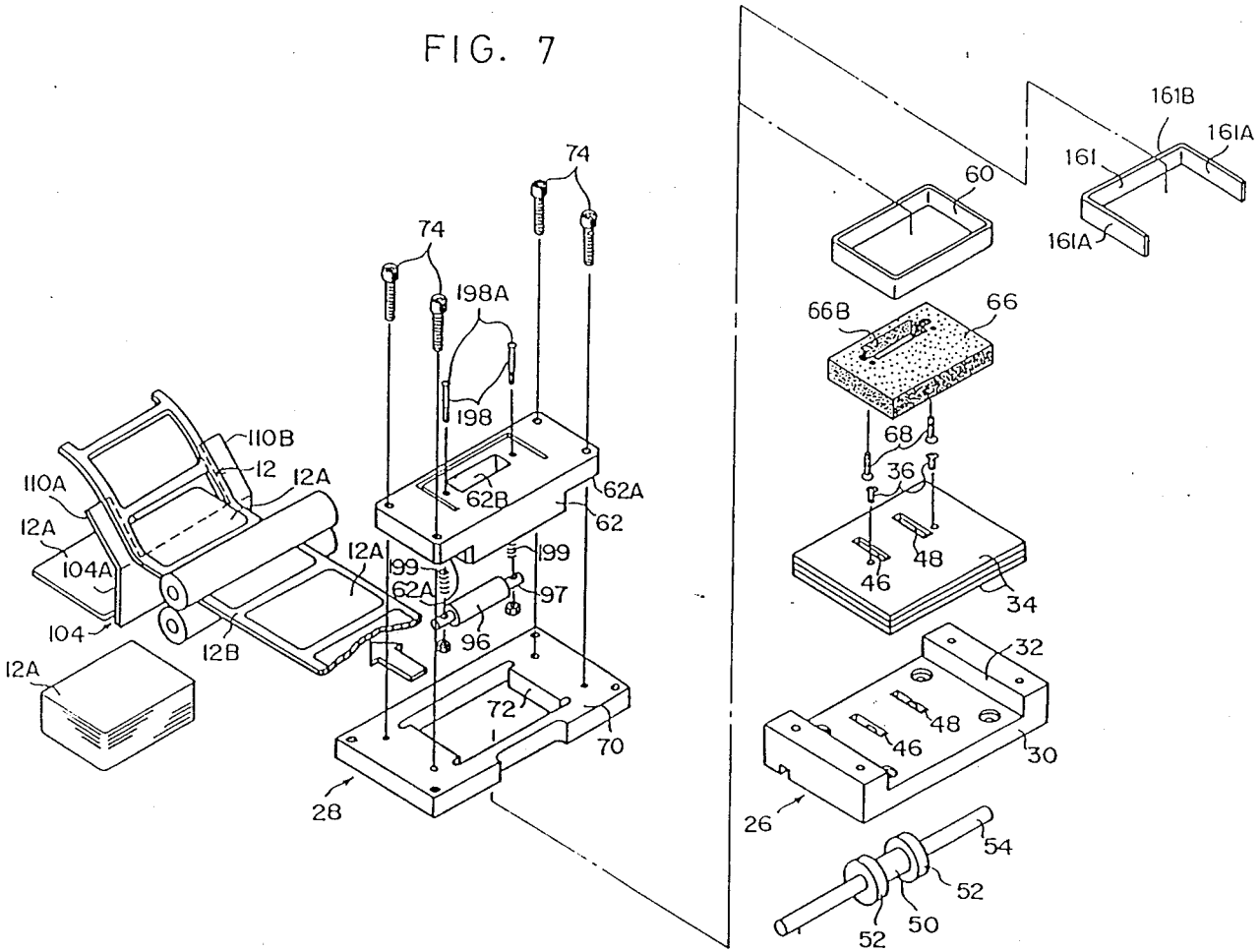
FIG. 7 is an exploded perspective view of a fourth embodiment of the present invention corresponding to FIG. 3 of the first embodiment.

A fourth embodiment of the present invention will be described below with reference to FIGS. 7 and 8. In this embodiment, the same components and members as those in the second embodiment are indicated by the same reference numerals, and the description for them will not be repeated.

Figure 9:
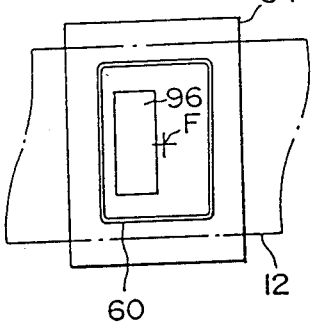
FIGS. 9A and 9B are plan views of the relationship between a moving punching blade and a moving cutting blade of a fourth embodiment.
Figure 9:
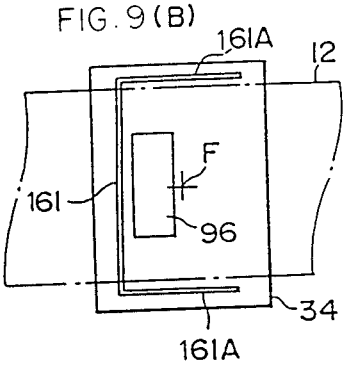

This embodiment is arranged such that a moving punching blade 60 or a moving cutting blade 161 are selectively attached to the cutting plate 62 on the moving block 28. The moving punching blade 60 is formed by bending a thin plate so that the longitudinal axis forms a rectangle in the same manner as that of the above-described embodiments. The upper end of the punching blade is accommodated in a recess 64 formed in a lower surface of the cutting plate 62, and the lower end projects downwardly from the cutting plate 62. The moving cutting blade 161 is designed to be attached after the moving punching blade 60 has been removed from the recess 64 of the cutting plate 62. The cutting blade 161 has a generally U-shaped form and is constituted by a linear cutting portion 161B used to cut photographic paper and extensions 161A which extend from the opposite ends of the cutting portion 161B in the direction generally perpendicular to the cutting portion 161B. As shown in FIG. 8, grooves 64A are formed in a lower surface of the cutting plate 62 on which the moving cutting blade 161 is supported so that the moving cutting blade 161 can be attached to the cutting plate. When the moving cutting blade 161 is attached to the cutting plate 62, the extensions 161A are positioned outside the photographic paper which is being transported, so as to extend in the longitudinal direction of the photographic paper. Therefore, the extensions 161A do not face the photographic paper 12 and do not have any function of cutting the photographic paper 12. The pressing plate 70 and the cutting plate 62 are mounted in such a manner that their axes are aligned with the center axis of the moving cutting blade 60. In other words, the center of the moving punching blade 60 corresponds to the center of pressing force (at the point F in FIG. 9(A)) so that the moving punching blade 60 is uniformly pressed against the seat plate 34 when the moving block 28 is moved down. When the moving cutting blade 161 is attached to the cutting plate, the center of the moving cutting blade 60 also corresponds to the center of pressing force (at the point F in FIG. 9 (B)) since the moving cutting blade has the extensions 161A.

Other constructions are the same as those in the second embodiment and the description for them will not be repeated.

The operation of this embodiment will now be described below.

When the photographic paper is punched by using the moving cutting blade 60, the operation is the same as that of the second embodiment. Therefore, the operation in accordance with the fourth embodiment will be described below with respect to only the case where the photographic paper is cut by the moving cutting blade 161. The moving cutting blade 161 is first inserted into the cutting plate 62 instead of the moving punching blade 60. The moving block 28 is moved down relative to the fixed block 26 in the same manner as that in the case of the moving punching blade 60, thereby cutting the photographic paper 12. Since, as shown in FIG. 9B, the center of the pressing force of the moving cutting blade 161 corresponds to that of the moving punching blade by the effect of the extensions 161A, it is possible to uniformly press the moving cutting blade 161 against the seat plate 34 even when the cutting portion of the moving cutting blade 161 deviates from the point F. Moreover, the magnitude of friction between the cutting blade and a portion of the seat plate 34 which is in contact with the cutting blade is small. In this case also, the upper roller 96 and the large-diameter portions function to apply a transporting force to the photographic paper 12 in the same manner as that in the other embodiments. Even if the upper roller 96 and the large-diameter portions are removed, the cutting operation can be effected by altering the arrangement of the transporting rollers. However, the cutting operation can be effected more easily and speedily by simply replacing the moving punching blade 60 with the moving cutting blade 161 without removing the upper roller 96 and the large-diameter portions 52.

What is claimed is:

1. A sheet punching cutter for punching a sheet of material comprising:

a fixed block;

a moving punching blade having an aperture defined therein and being moveable towards and away from said fixed block, said sheet being disposed between said fixed block and said punching blade such that movement thereof toward said fixed block causes a portion of said sheet to be punched therefrom, the unpunched portion being a punched-remainder portion;

a transporting roller disposed inside said moving punching blade for transporting a punched-out portion of said sheet punched by said moving punching blade, said transporting roller being driven so as to convey said punched-out portion at a first speed; and transporting means for moving said sheet to the punching position at which said sheet is punched and moving said sheet away from said punching position, said transporting means conveying said sheet at a second speed, wherein said second speed is different from said first speed to facilitate the separation of said punched out portion from said sheet.

2. A sheet punching cutter according to claim 1, further comprising separating means for guiding said punched-out portion and the punched-remainder portion of said sheet in different directions.

3. A sheet punching cutter according to claim 1, further comprising a machine base, wherein said fixed block is fixed to said machine base; said moving blade is supported on said machine base so that said moving blade can be brought toward to and moved away from said fixed block; and said transporting roller is supported on said machine base.

4. A sheet punching cutter according to claim 3, wherein urging means is disposed between said machine base and said transporting roller for urging said transporting roller toward said sheet.

5. A sheet punching cutter according to claim 1, further comprising a moving block on which said moving punching blade is supported, wherein moving said moving punching blade toward and away from said fixed block is effected by moving said moving block toward and away from said fixed block.

6. A sheet punching cutter according to claim 5, wherein said transporting roller is supported on said moving block and wherein an urging means is disposed between said moving block and said transporting roller, said transporting roller being urged in the direction of said sheet.

7. A sheet punching cutter according to claim 5, further comprising separating means for guiding said punched-out portion and the punched-remainder portion of said sheet in different directions.

8. A sheet punching cutter according to claim 5, further comprising a moving cutting blade which is supported on said moving block and which is brought toward and away from said fixed block together with said moving punching blade so as to cut said punched-remainder portion of said sheet after punching.

9. A sheet punching cutter according to claim 5, wherein said moving punching blade is formed of a thin strip member which is bent so as to have an annular shape.

10. A sheet punching cutter according to claim 5, wherein said moving punch blade is formed of a thin strip member which has a generally rectangular shape.

11. A sheet punching cutter according to claim 1, further comprising a moving cutting blade which is moved toward to and away from said fixed block together with said moving punching blade so as to cut said punched-remainder portion of said sheet after punching.

12. A sheet punching cutter for punching a sheet of material, comprising:

a machine base;

a fixed block supported on said machine base;

a moving block supported on said machine base and being moveable toward or away from said fixed block;

a moving punching blade supported on said moving block and being moveable toward and away from said fixed block; said sheet being disposed between said fixed block and said punching blade such that movement thereof toward said fixed block causes a portion of said sheet to be punched therefrom, the unpunched portion being a punched-remainder portion;

a transporting roller disposed inside the moving punching blade for transporting a punched-out portion of said sheet punched by said moving punching blade, said transporting roller being driven so as to convey said punched-out portion at a first speed; and transporting means for moving said sheet to the punching position at which said sheet is punched and moving said sheet away from said punching position, said transporting means conveying said sheet at a second speed, wherein said second speed is different from said first speed to facilitate the separation of said punched out portion from said sheet.

13. A sheet punching cutter according to claim 12, further comprising separating means for guiding said punched-out portion and the punched-remainder portion of said sheet in different directions.

14. A sheet punching cutter according to claim 12, wherein said transporting roller is supported on said machine base and wherein a spring for urging said transporting roller in the direction of said sheet is interposed between said machine base and said transporting roller.

15. A sheet punching cutter according to claim 12, said transporting roller is supported on said moving block and wherein a spring for urging said transporting roller in the direction of said sheet is interposed between said moving block and said transporting roller.

16. A sheet punching cutter according to claim 12, further comprising a moving cutting blade which is supported on said moving block and which functions to cut, after punching, said punched-remainder portion of said sheet by moving said moving block close to and then away from said fixed block.

17. A sheet punching cutter according to claim 16, wherein said moving punching blade is rectangular and said moving cutting blade is straight.

18. A sheet punching cutter according to claim 12, wherein a resilient member is disposed inside said moving punching blade.

19. A sheet punching cutter according to claim 12, wherein said moving punching blade is endless.

* * * * *